US011538618B2

(12) United States Patent
Kim et al.

(10) Patent No.: US 11,538,618 B2
(45) Date of Patent: Dec. 27, 2022

(54) COIL COMPONENT

(71) Applicant: SAMSUNG ELECTRO-MECHANICS CO., LTD., Suwon-si (KR)

(72) Inventors: Jin Young Kim, Suwon-si (KR); Jong Min Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 687 days.

(21) Appl. No.: 16/554,285

(22) Filed: Aug. 28, 2019

(65) Prior Publication Data

US 2020/0219644 A1 Jul. 9, 2020

(30) Foreign Application Priority Data

Jan. 9, 2019 (KR) ..... 10-2019-0002631

(51) Int. Cl.
*H01F 27/28* (2006.01)
*H01F 27/29* (2006.01)

(52) U.S. Cl.
CPC ..... *H01F 27/2804* (2013.01); *H01F 27/292* (2013.01); *H01F 2027/2809* (2013.01)

(58) Field of Classification Search
CPC ..... H01F 27/2804; H01F 2027/2809; H01F 17/0013; H01F 17/0006; H01F 5/003; H01F 27/29; H01F 27/292
USPC ..... 336/200, 232
See application file for complete search history.

(56) References Cited

U.S. PATENT DOCUMENTS

| | | | | |
|---|---|---|---|---|
| 6,600,404 | B1 * | 7/2003 | Kajino | H01F 5/003 336/200 |
| 2015/0035634 | A1 * | 2/2015 | Nakamura | H01F 41/046 336/170 |
| 2016/0322154 | A1 * | 11/2016 | Park | H01F 17/04 |
| 2021/0082614 | A1 * | 3/2021 | Kim | H01F 27/323 |

FOREIGN PATENT DOCUMENTS

| | | | | |
|---|---|---|---|---|
| JP | 2006-237398 | A | 9/2006 | |
| JP | 2006237398 | A * | 9/2006 | |
| JP | 2014209590 | A * | 11/2014 | H01F 27/292 |
| KR | 10-2016-0128618 | A | 11/2016 | |
| WO | WO-2016147993 | A1 * | 9/2016 | H01F 17/0013 |

* cited by examiner

*Primary Examiner* — Tszfung J Chan
(74) *Attorney, Agent, or Firm* — Morgan, Lewis & Bockius LLP

(57) ABSTRACT

A coil component includes a body; an insulating substrate embedded in the body; and a coil portion disposed on at least one surface of the insulating substrate. The insulating substrate is inclined with respect to one surface of the body, in a cross-section of the body in a width-thickness direction.

15 Claims, 7 Drawing Sheets

COIL COMPONENT

CROSS-REFERENCE TO RELATED APPLICATION(S)

This application claims benefit of priority to Korean Patent Application No. 10-2019-0002631 filed on Jan. 9, 2019 in the Korean Intellectual Property Office, the disclosure of which is incorporated herein by reference in its entirety.

TECHNICAL FIELD

The present disclosure relates to a coil component.

BACKGROUND

An inductor, a coil component, is a typical passive electronic component used in electronic devices, along with a resistor and a capacitor.

In the case of a thin film type component, one of coil components, a coil pattern may be formed on an insulating substrate by a thin film process such as a plating process, one or more of magnetic composite sheets may be stacked on an insulating substrate on which the coil pattern is formed, to form a body, and external electrodes are formed on a surface of the body.

With higher performance and smaller sizes gradually implemented in electronic devices, the number of coil components used in electronic devices has been increasing and becoming smaller.

In order to achieve high performance of the coil component, it is necessary to form a large magnetic core.

SUMMARY

An aspect of the present disclosure is to provide a coil component capable of implementing high-capacity inductance while being low profile.

According to an aspect of the present disclosure, a coil component includes a body; an insulating substrate embedded in the body; and a coil portion disposed on at least one surface of the insulating substrate. The insulating substrate is inclined with respect to one surface of the body, in a cross-section of the body in a width-thickness direction.

BRIEF DESCRIPTION OF DRAWINGS

The above and other aspects, features, and advantages of the present disclosure will be more clearly understood from the following detailed description, taken in conjunction with the accompanying drawings, in which.

DETAILED DESCRIPTION

Figure 1:
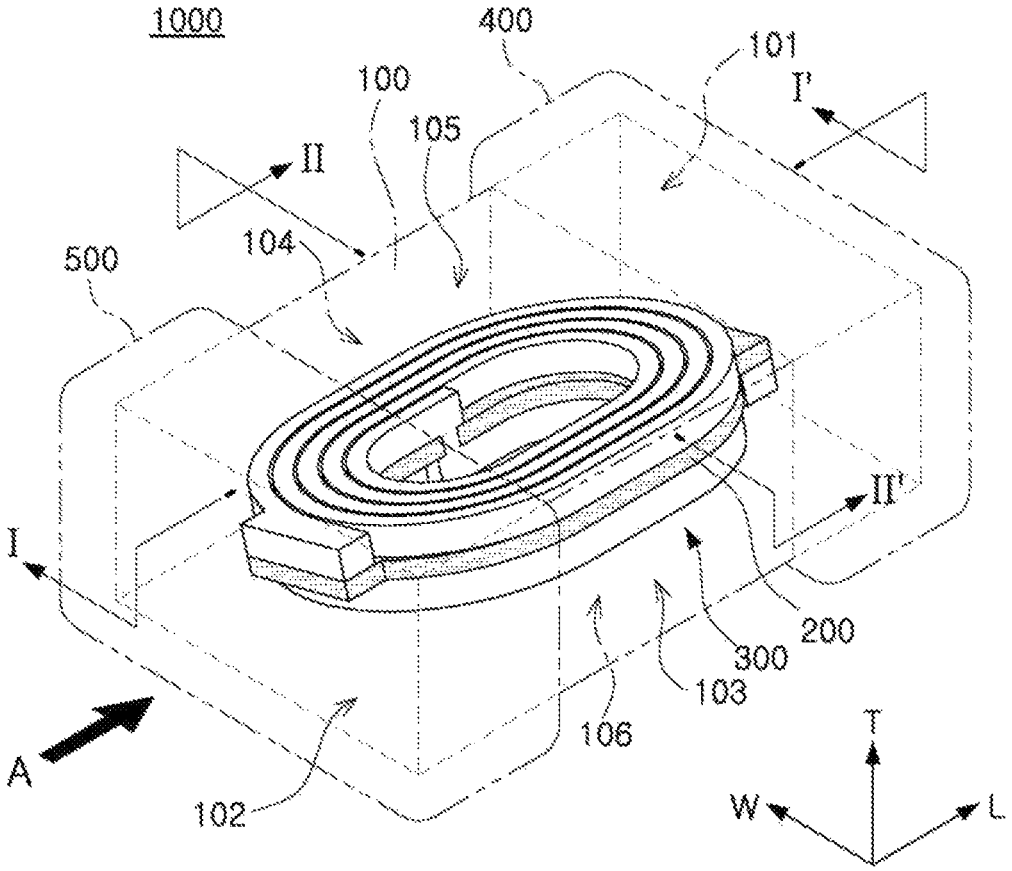
FIG. 1 is a schematic view illustrating a coil component according to an embodiment of the present disclosure.

The terms used in the description of the present disclosure are used to describe a specific embodiment, and are not intended to limit the present disclosure. A singular term includes a plural form unless otherwise indicated. The terms "include," "comprise," "is configured to," etc. of the description of the present disclosure are used to indicate the presence of features, numbers, steps, operations, elements, parts, or combination thereof, and do not exclude the possibilities of combination or addition of one or more additional features, numbers, steps, operations, elements, parts, or combination thereof. Also, the terms "disposed on," "positioned on," and the like, may indicate that an element is positioned on or beneath an object, and does not necessarily mean that the element is positioned above the object with reference to a gravity direction.

The term "coupled to," "combined to," and the like, may not only indicate that elements are directly and physically in contact with each other, but also include the configuration in which another element is interposed between the elements such that the elements are also in contact with the other component.

Sizes and thicknesses of elements illustrated in the drawings are indicated as examples for ease of description, and the present disclosure are not limited thereto.

In the drawings, a T direction is a first direction or a thickness direction, an L direction is a second direction or a length (longitudinal) direction, a W direction is a third direction or a width direction.

Hereinafter, a coil component according to an embodiment of the present disclosure will be described in detail with reference to the accompanying drawings. Referring to the accompanying drawings, the same or corresponding components may be denoted by the same reference numerals, and overlapped descriptions will be omitted.

In electronic devices, various types of electronic components may be used, and various types of coil components may be used between the electronic components to remove noise, or for other purposes.

In other words, in electronic devices, a coil component may be used as a power inductor, a high frequency (HF) inductor, a general bead, a high frequency (GHz) bead, a common mode filter, and the like.

Figure 2:
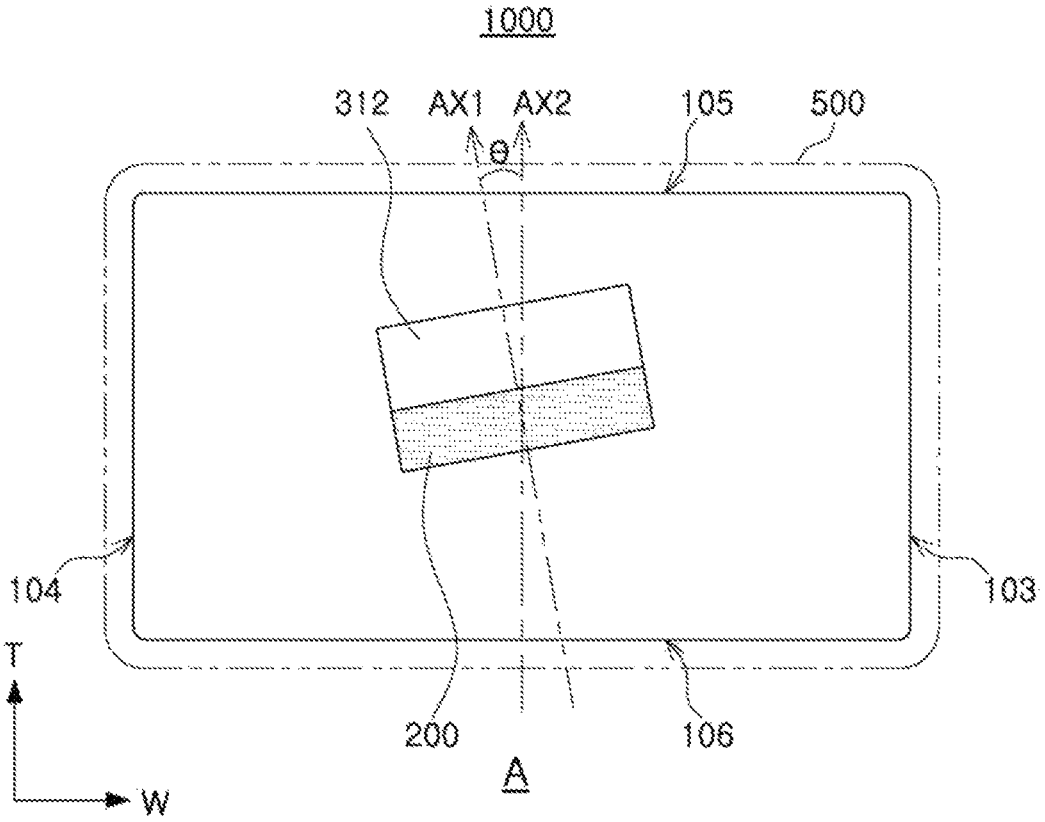
FIG. 2 is a schematic view illustrating FIG. 1, when viewed in direction A.
Figure 3:
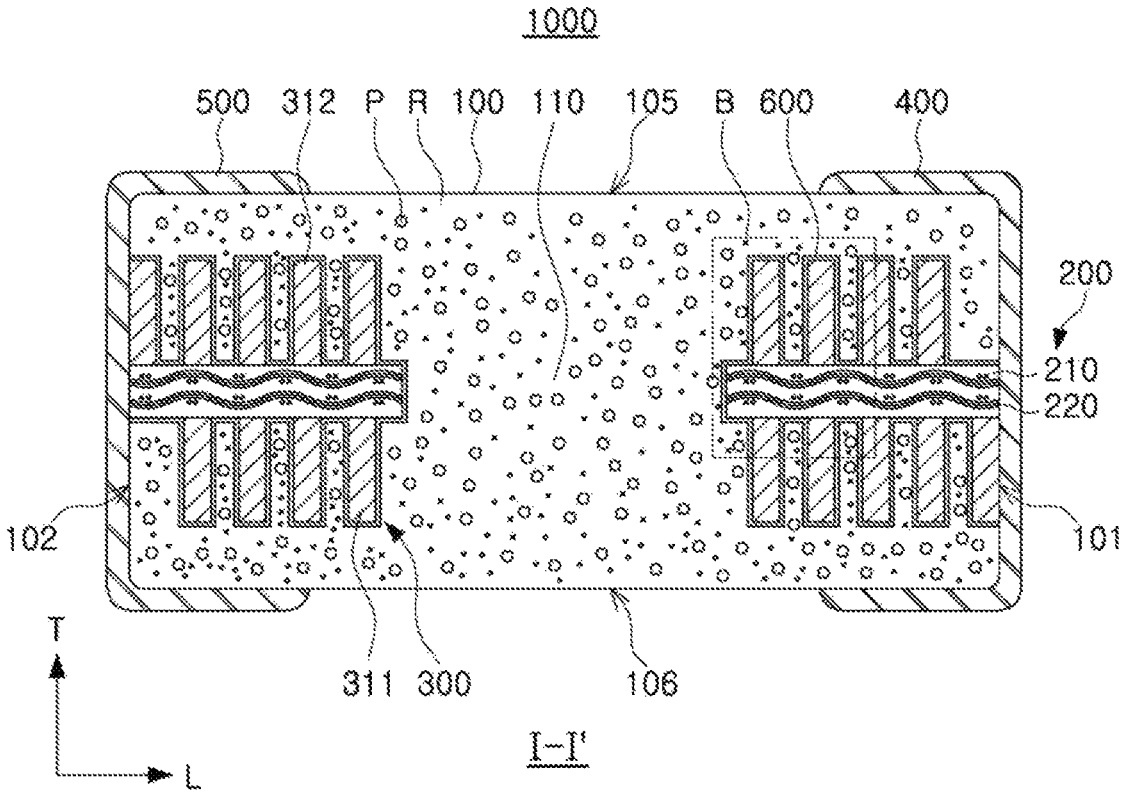
FIG. 3 is a cross-sectional view taken along line I-I' of FIG. 1.
Figure 4:
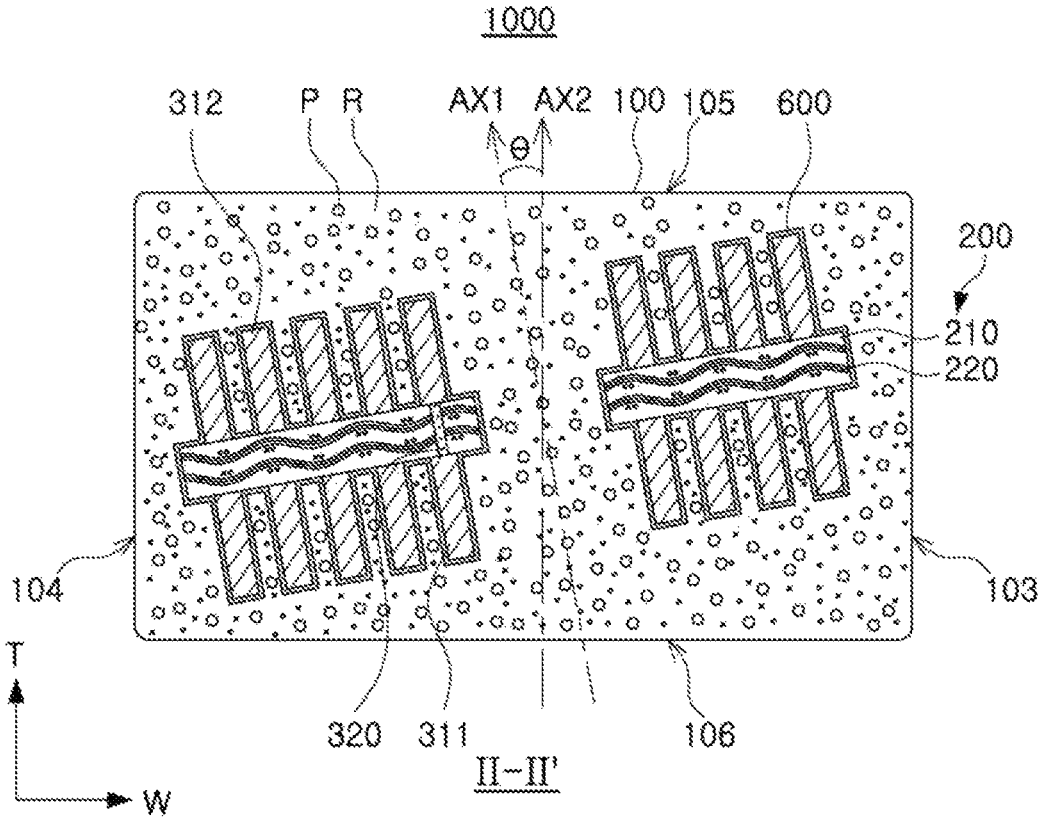
FIG. 4 is a cross-sectional view taken along line II-II' of FIG. 1.
Figure 5:
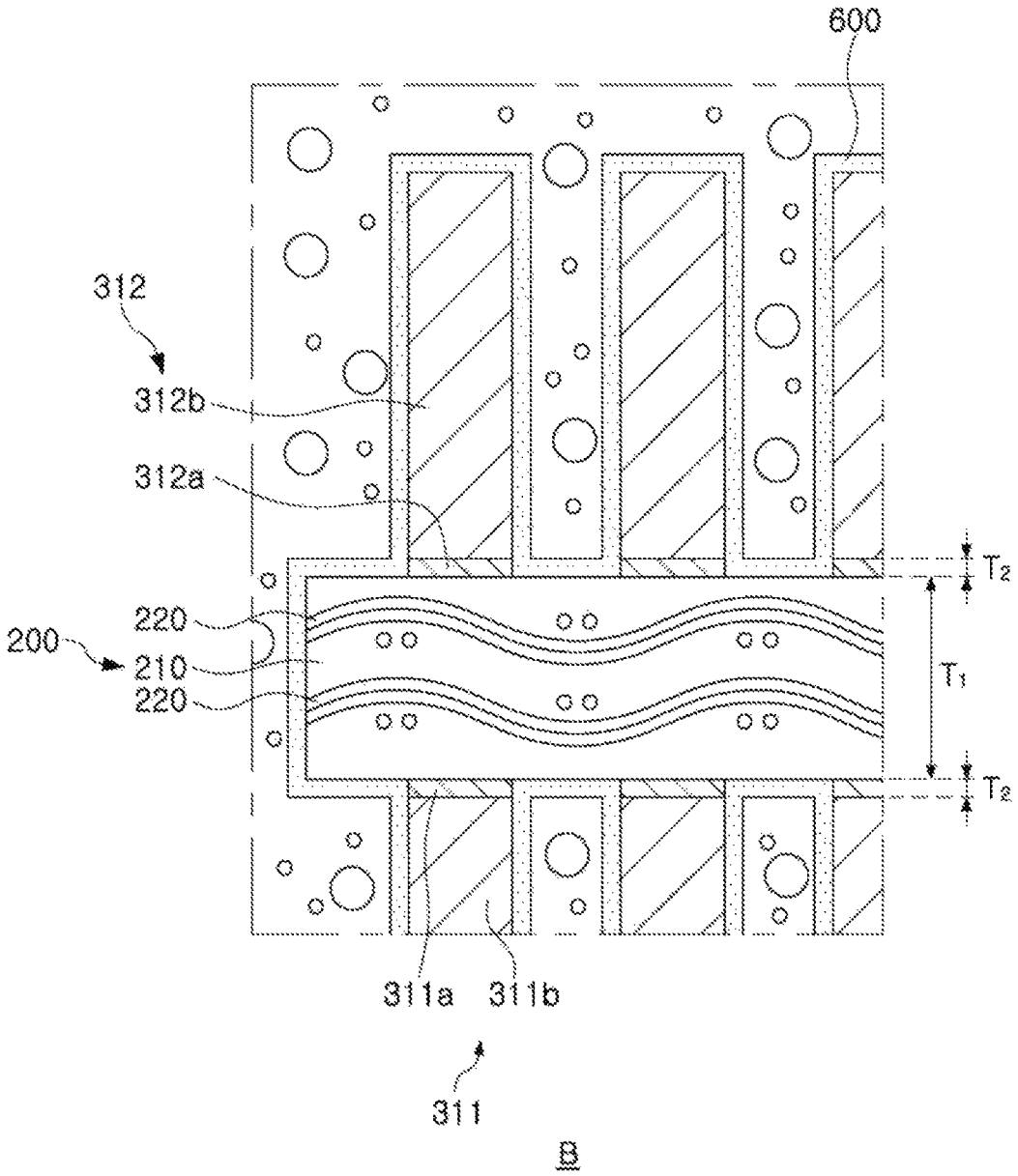
FIG. 5 is an enlarged view of portion B of FIG. 3.
Figure 6:
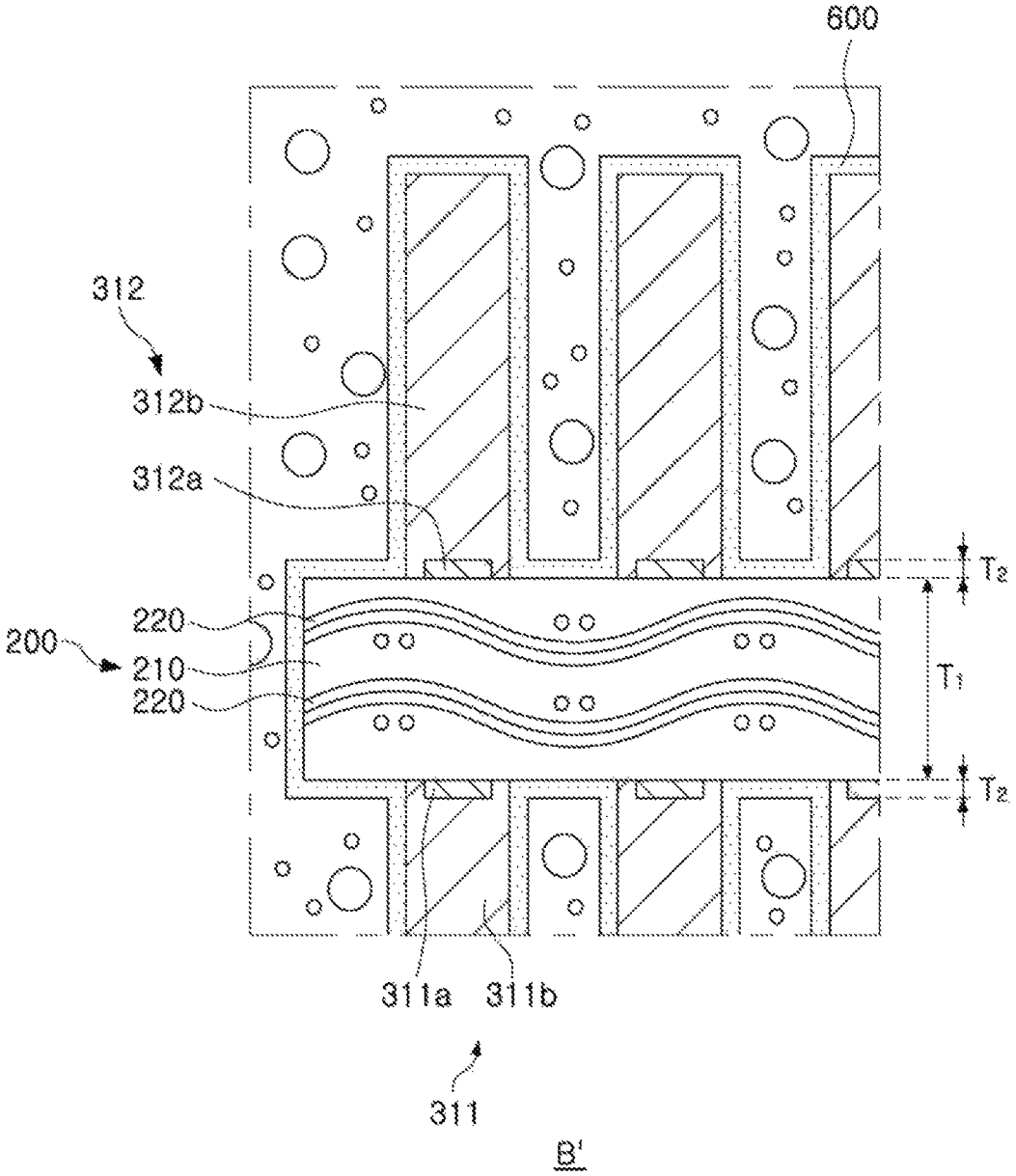
FIG. 6 is a view illustrating a modification of portion B of FIG. 3.

FIG. 1 is a schematic view illustrating a coil component according to an embodiment of the present disclosure. FIG. 2 is a schematic view illustrating FIG. 1, when viewed in direction A. FIG. 3 is a cross-sectional view taken along line I-I' of FIG. 1. FIG. 4 is a cross-sectional view taken along line II-II' of FIG. 1. FIG. 5 is an enlarged view of portion B of FIG. 3. FIG. 6 is a view illustrating a modification of portion B of FIG. 3.

Referring to FIGS. 1 to 6, a coil component 1000 according to an embodiment of the present disclosure may include a body 100, an insulating substrate 200, a coil portion 300, and external electrodes 400 and 500, and may further include an insulating film 600.

The body 100 may form an exterior of the coil component 1000 according to this embodiment, and the insulating substrate 200 and the coil portion 300 may be embedded therein.

The body 100 may be formed to have a hexahedral shape overall.

Referring to FIGS. 1 to 4, the body 100 may include a first surface 101 and a second surface 102 facing each other in a longitudinal direction L, a third surface 103 and a fourth surface 104 facing each other in a width direction W, and a fifth surface 105 and a sixth surface 106 facing each other in a thickness direction T. Each of the first to fourth surfaces 101, 102, 103, and 104 of the body 100 may correspond to wall surfaces of the body 100 connecting the fifth surface 105 and the sixth surface 106 of the body 100. Hereinafter, both end surfaces of the body 100 may refer to the first surface 101 and the second surface 102 of the body, both side surfaces of the body 100 may refer to the third surface 103 and the fourth surface 104 of the body 100, one surface of the body 100 may refer to the sixth surface 106 of the body 100, and the other surface of the body 100 may refer to the fifth surface 105 of the body 100. Further, hereinafter, a lower surface and an upper surface of the body 100 may refer to the sixth surface 106 and the fifth surface 105 of the body 100, respectively, based on the directions of FIGS. 1 to 4.

The body 100 may be formed such that the coil component 1000 according to this embodiment in which the external electrodes 400 and 500 to be described later are formed has a length of 2.0 mm, a width of 1.2 mm, and a thickness of 0.65 mm, but is not limited thereto. Alternatively, the body 100 may be formed such that the coil component 1000 according to this embodiment in which the external electrodes 400 and 500 to be described later are formed has a length of 2.0 mm, a width of 1.6 mm, and a thickness of 0.55 mm. Alternatively, the body 100 may be formed such that the coil component 1000 according to this embodiment in which the external electrodes 400 and 500 to be described later are formed has a length of 2.0 mm, a width of 1.2 mm, and a thickness of 0.55 mm. Alternatively, the body 100 may be formed such that the coil component 1000 according to this embodiment in which the external electrodes 400 and 500 to be described later are formed has a length of 1.2 mm, a width of 1.0 mm, and a thickness of 0.55 mm. Since the above-described sizes of the coil component 1000 according to this embodiment are merely illustrative, cases in which sizes are smaller than the above-mentioned sizes may not be excluded from the scope of the present disclosure.

The body 100 may include a magnetic powder particle (P) and an insulating resin (R). Specifically, the body 100 may be formed by stacking at least one magnetic composite sheet including the insulating resin (R) and the magnetic powder particle (P) dispersed in the insulating resin (R), and then curing the magnetic composite sheet. The body 100 may have a structure other than the structure in which the magnetic powder particle (P) may be dispersed in the insulating resin (R). For example, the body 100 may be made of a magnetic material such as ferrite.

The magnetic powder particle (P) may be, for example, a ferrite powder particle or a metal magnetic powder particle.

Examples of the ferrite powder particle may include at least one or more of spinel type ferrites such as Mg—Zn-based ferrite, Mn—Zn-based ferrite, Mn—Mg-based ferrite, Cu—Zn-based ferrite, Mg—Mn—Sr-based ferrite, Ni—Zn-based ferrite, and the like, hexagonal ferrites such as Ba—Zn-based ferrite, Ba—Mg-based ferrite, Ba—Ni-based ferrite, Ba—Co-based ferrite, Ba—Ni—Co-based ferrite, and the like, garnet type ferrites such as Y-based ferrite, and the like, and Li-based ferrites.

The metal magnetic powder particle may include one or more of iron (Fe), silicon (Si), chromium (Cr), cobalt (Co), molybdenum (Mo), aluminum (Al), niobium (Nb), copper (Cu), and nickel (Ni). For example, the metal magnetic powder particle may be at least one or more of a pure iron powder, a Fe—Si-based alloy powder, a Fe—Si—Al-based alloy powder, a Fe—Ni-based alloy powder, a Fe—Ni—Mo-based alloy powder, a Fe—Ni—Mo—Cu-based alloy powder, a Fe—Co-based alloy powder, a Fe—Ni—Co-based alloy powder, a Fe—Cr-based alloy powder, a Fe—Cr—Si-based alloy powder, a Fe—Si—Cu—Nb-based alloy powder, a Fe—Ni—Cr-based alloy powder, and a Fe—Cr—Al-based alloy powder.

The metallic magnetic powder particle may be amorphous or crystalline. For example, the metal magnetic powder particle may be a Fe—Si—B—Cr-based amorphous alloy powder, but is not limited thereto.

The ferrite powder and the metal magnetic powder particle may have an average diameter of about 0.1 μm to 30 μm, respectively, but are not limited thereto.

The body 100 may include two or more types of magnetic powder particles (P) dispersed in an insulating resin (R). In this case, the term "different types of magnetic powder particle (P)" means that the magnetic powder particles (P) dispersed in the insulating resin (R) are distinguished from each other by diameter, composition, crystallinity, and a shape. For example, the body 100 may include two or more magnetic powder particles (P) of different diameters.

The insulating resin (R) may include an epoxy, a polyimide, a liquid crystal polymer, or the like, in a single form or in combined forms, but is not limited thereto.

The body 100 may include a core 110 passing through the coil portion 300 to be described later. The core 110 may be formed by filling at least a portion of the magnetic composite sheet with through-holes formed in the insulating substrate 200 in operations of stacking and curing the magnetic composite sheet, but is not limited thereto.

The insulating substrate 200 may be embedded in the body 100. The insulating substrate 200 may support the coil portion 300 to be described later. The through-holes may be formed in the insulating substrate 200, to dispose the core 110 described above.

The insulating substrate 200 may be rotated about the longitudinal direction L of the body 100, and may be inclined in the body 100. For example, a center axis AX1 (e.g., a longitudinal axis) of the through-hole on a cross-section (W-T plane) in a width-thickness direction of the body 100 may be disposed to be inclined in the body 100, to have a constant angle (θ) with respect to an axis AX2 in the thickness direction T of the body 100. For example, a major surface, for example, an upper surface or a lower surface, of the insulating substrate 200 on which a conductive layer of the coil portion 300 is disposed, and one of the fifth and sixth surfaces 105 and 106 may have an angle (θ), and on the other hand, the major surface of the insulating substrate 200 may be perpendicular to, or substantially perpendicular to, one of the first and second surfaces 101 and 102. The term, "substantially," reflects consideration of recognizable process errors which may occur during manufacturing.

A maximum area of a cross-section (L-W plane) of the core 110 in a length-width direction of the body 100 may increase, as the insulating substrate 200 is inclined in the body 100. Therefore, the component characteristics such as the inductance and the quality factor of the coil component 1000, and the like, according to this embodiment may be improved.

The angle (θ) between the center axis AX1 of the through-hole and the axis AX2, parallel to the thickness direction T of the body 100, in the width-thickness direction (W-T plane) of the body 100 may be 10 degrees or more and 20 degrees or less. When the angle between the center axis AX1 of the through-hole and the axis AX2, parallel to the thickness direction T of the body 100, is less than 10 degrees, the above-described effect of increasing the cross-sectional area of the core 110 may be insignificant. Therefore, it may be difficult to improve the component characteristics. When the angle between the center axis AX1 of the through-hole and the axis AX2, parallel to the thickness direction T of the body 100, is more than 20 degrees, the magnetic flux density may be relatively non-uniform. Therefore, the component characteristics may be deteriorated.

The insulating substrate 200 may be formed of an insulating material including a thermosetting insulating resin such as an epoxy resin, a thermoplastic insulating resin such as polyimide, or a photosensitive insulating resin, or may be formed of an insulating material in which a reinforcing material such as a glass fiber or an inorganic filler is impregnated with such an insulating resin. For example, the insulating substrate 200 may be formed of an insulating material such as prepreg, Ajinomoto Build-up Film (ABF), FR-4, a bismaleimide triazine (BT) resin, a photoimageable dielectric (PID), and the like, but are not limited thereto.

As the inorganic filler, at least one or more selected from a group consisting of silica ($SiO_2$), alumina ($Al_2O_3$), silicon carbide (SiC), barium sulfate ($BaSO_4$), talc, mud, a mica powder, aluminum hydroxide ($Al(OH)_3$), magnesium hydroxide ($Mg(OH)_2$), calcium carbonate ($CaCO_3$), magnesium carbonate ($MgCO_3$), magnesium oxide (MgO), boron nitride (BN), aluminum borate ($AlBO_3$), barium titanate ($BaTiO_3$), and calcium zirconate ($CaZrO_3$) may be used.

When the insulating substrate 200 is formed of an insulating material including a reinforcing material, the insulating substrate 200 may provide better rigidity. When the insulating substrate 200 is formed of an insulating material not containing glass fibers, the insulating substrate 200 may be advantageous for reducing a thickness of the overall coil portion 300. When the insulating substrate 200 is formed of an insulating material containing a photosensitive insulating resin, the number of processes for forming the coil portion 300 may be reduced. Therefore, it may be advantageous in reducing production costs, and a fine via may be formed.

Hereinafter, the insulating substrate 200 according to this embodiment will be described as including an insulating resin 210 and a glass cloth 220 impregnated with the insulating resin 210, but is for convenience of explanation, and is not limited thereto. As a non-limiting example, the insulating substrate 200 may be formed of a copper clad laminate (CCL). The glass cloth 220 means that a plurality of glass fibers are woven.

The glass cloth 220 may be formed as a plurality of layers. When the glass cloth is formed as a plurality of layers, the rigidity of the insulating substrate 200 may be improved. Also, even when the insulating substrate 200 is damaged in an operation of removing first conductive layers 311*a* and 312*a* to be described later, a shape of the insulating substrate 200 may be maintained and the defect rate may be reduced.

A thickness T1 of the insulating substrate 200 may be 20 μm or more and 40 μm or less, and more preferably 25 μm or more and 35 μm or less. When the thickness T1 of the insulating substrate 200 is less than 20 μm, it may be difficult to secure the rigidity of the insulating substrate 200, to support the coil portion 300 to be described later in the manufacturing process. When the thickness T1 of the insulating substrate 200 is more than 40 μm, it may be disadvantageous to make the coil portions thinner, and it may be disadvantageous in realizing high capacity inductance, since a volume occupied by the insulating substrate 200 in the body of the same volume increases.

The coil portion 300 may include coil patterns 311 and 312, having a planar spiral shape, arranged on the insulating substrate 200, and may be embedded in the body 100, to manifest the characteristics of the coil component. For example, when the coil component 1000 of this embodiment is used as a power inductor, the coil portion 300 may function to stabilize the power supply of an electronic device by storing an electric field as a magnetic field and maintaining an output voltage.

The coil portion 300 may include the coil patterns 311 and 312, and a via 320. Specifically, based on the directions of FIGS. 1, 3 and 4, a first coil pattern 311 may be disposed on a lower surface of the insulating substrate 200 facing the sixth surface 106 of the body 100, and a second coil pattern 312 may be disposed on an upper surface of the insulating substrate 200. The via 320 may pass through the insulating substrate 200, and may be in contact with and connected to the first coil pattern 311 and the second coil pattern 312, respectively. In this configuration, the coil portion 300 may function as a single coil which forms one or more turns about the core 110 overall.

Each of the first coil pattern 311 and the second coil pattern 312 may be in a planar spiral shape having at least one turn formed about the core 110. For example, based on the direction of FIG. 3, the first coil pattern 311 may form at least one turn about the core 110 on the lower surface of the insulating substrate 200.

End portions of the first and second coil patterns 311 and 312 may be connected to the first and second external electrodes 400 and 500, respectively, which will be described later. For example, the end portion of the first coil pattern 311 may be connected to the first external electrode 400, and the end portion of the second coil pattern 312 may be connected to the second external electrode 500.

For example, the end portion of the first coil pattern 311 may be exposed from the first surface 101 of the body 100, and the end portion of the second coil pattern 312 may be exposed from the second surface 102 of the body 100, to be in contact with and connected to the first and second external electrodes 400 and 500 disposed on the first and second surfaces 101 and 102 of the body 100, respectively.

Each of the first and second coil patterns 311 and 312 may include first conductive layers 311*a* and 312*a* formed to contact the insulating substrate 200, and second conductive layers 311*b* and 312*b* disposed on the first conductive layers 311*a* and 312*a*. Based on the directions of FIGS. 4 and 5, the first coil pattern 311 may include a first conductive layer 311*a* formed to contact the lower surface of the insulating substrate 200, and a second conductive layer 311*b* disposed on the first conductive layer 311*a*. Based on the directions of FIGS. 4 and 5, the second coil pattern 312 may include a first conductive layer 312*a* formed to contact the upper surface of the insulating substrate 200, and a second conductive layer 312*b* disposed on the first conductive layer 312*a*.

The first conductive layers 311*a* and 312*a* may be seed layers for forming the second conductive layers 311*b* and 312*b* by an electrolytic plating process. The first conductive layers 311*a* and 312*a* may be formed to be thinner than the second conductive layers 311*b* and 312*b*. The first conductive layers 311*a* and 312*a* may be formed by a thin film process such as sputtering or an electroless plating process. When the first conductive layers 311*a* and 312*a* are formed by a thin film process such as sputtering, at least a portion of materials constituting the first conductive layers 311*a* and 312*a* may be passed through the insulating substrate 200. It can be confirmed that a concentration of a metal material constituting the first conductive layers 311*a* and 312*a* on the insulating substrate 200 varies in the thickness direction T of the body 100.

A thickness T2 of the first conductive layers 311*a* and 312*a* may be 1.5 μm or more and 3 μm or less. When the thickness of the first conductive layers 311*a* and 312*a* is less than 1.5 μm, the first conductive layers 311*a* and 312*a* may be formed non-uniformly, such that possibility of occurring the plating failure may be high when the second conductive layers 311*b* and 312*b* are formed by an electrolytic plating process. When the thickness of the first conductive layers 311*a* and 312*a* is more than 3 μm, there may be a high possibility that undercuts are excessively generated in side surfaces of the first conductive layers 311*a* and 312*a*, depending on a specific method.

Referring to FIG. 5, the second conductive layers 311*b* and 312*b* may expose at least a portion of the side surfaces of the first conductive layers 311*a* and 312*a*. In this embodiment, a seed layer for forming the first conductive layers 311*a* and 312*a* may be formed on both side surfaces of the insulating substrate 200, a plating resist for forming the second conductive layers 311*b* and 312*b* may be formed on the seed layer, the second conductive layers 311*b* and 312*b* may be formed by the electrolytic plating process, the plating resist may be removed, and the seed layer on which the second conductive layers 311*b* and 312*b* are not formed may be selectively removed. Therefore, at least a portion of the side surfaces of the first conductive layers 311*a* and 312*a* formed by selectively removing the seed layer may be exposed without being covered by the second conductive layers 311*b* and 312*b*. The seed layer may be formed by performing an electroless plating process or a sputtering process on the insulating substrate 200. Alternatively, the seed layer may be a copper foil of a copper clad laminate (CCL). The plating resist may be formed by applying a material for forming the plating resist to the seed layer and then performing a photolithography process thereon. After performing the photolithography process, an opening may be formed in a region in which the second conductive layers 311*b* and 312*b* are to be formed. The selective removal of the seed layer may be performed by a laser process or an etching process. In the case in which the seed layer is selectively removed by etching, the first conductive layers 311*a* and 312*a* may be formed in such a manner that the cross-sectional area thereof increases as the side surfaces thereof proceed in a downward direction.

Referring to FIG. 6, the second conductive layers 311*b* and 312*b* may cover the first conductive layers 311*a* and 312*a*. In a different manner to FIG. 5, the first conductive layers 311*a* and 312*a* patterned in a plane spiral shape may be respectively formed on both side surfaces of the insulating substrate 200, and the second conductive layers 311*b* and 312*b* may be formed on the first conductive layers 311*a* and 312*a* by an electrolytic plating process. When the second conductive layers 311*b* and 312*b* are formed by an anisotropic plating process, a plating resist may not be used, but is not limited thereto. When the second conductive layers 311*b* and 312*b* are formed by an isotropic plating process, a plating resist for forming the second conductive layer may be used. An opening for exposing the first conductive layers 311*a* and 312*a* may be formed in the plating resist for forming the second conductive layer. A diameter of the opening may be larger than a line width of the first conductive layers 311*a* and 312*a*. Therefore, the second conductive layers 311*b* and 312*b* filling the opening may cover the first conductive layers 311*a* and 312*a*.

The via 320 may include at least one conductive layer. For example, when the via 320 is formed by an electrolytic plating process, the via 320 may include a seed layer formed on an inner wall of a via hole passing through the insulating substrate 200, and an electrolytic plating layer filling the via hole formed with the seed layer. The seed layer of the via 320 may be formed integrally with the first conductive layers 311*a* and 312*a* in the same process as the first conductive layers 311*a* and 312*a*, and may form a boundary between the seed layer and each of the first conductive layers 311*a* and 312*a* in a process different from the first conductive layers 311*a* and 312*a*. In the case of this embodiment, the seed layer of the via and the first conductive layers 311*a* and 312*a* may be formed in different processes to form a boundary therebetween.

When the line widths of the coil patterns 311 and 312 are excessively wide, a volume of the magnetic body in the body 100 may be reduced to adversely affect inductance. In a non-limiting example, an aspect ratio (AR) of the coil patterns 311 and 312 may be between 3:1 and 9:1.

Each of the coil patterns 311 and 312 and the via 320 may be formed of a conductive material such as copper (Cu), aluminum (Al), silver (Ag), tin (Sn), gold (Au), nickel (Ni), lead (Pb), titanium (Ti), chromium (Cr), or alloys thereof, but are not limited thereto. As a non-limiting example, when the first conductive layers 311*a* and 312*a* are formed in a sputtering process, and the second conductive layers 311*b* and 312*b* are formed by an electrolytic plating process, the first conductive layers 311*a* and 312*a* may include at least one of molybdenum (Mo), chromium (Cr), and titanium (Ti), and the second conductive layers 311*b* and 312*b* may include copper (Cu). As another non-limiting example, when the first conductive layers 311*a* and 312*a* are formed by an electroless plating process, and the second conductive layers 311*b* and 312*b* are formed by an electrolytic plating process, the first conductive layers 311*a* and 312*a*, and the second conductive layers 311*b* and 312*b* may include copper (Cu). In this case, a density of the copper (Cu) in the first conductive layers 311*a* and 312*a* may be lower than a density of the copper (Cu) in the second conductive layers 311*b* and 312*b*.

The thickness T1 of the insulating substrate 200 and the thickness T2 of the first conductive layers 311*a* and 312*a* satisfy $10 \leq T1/T2 \leq 20$. When T1/T2 is less than 10, or more than 20, the insulating substrate may have relatively low strength property, the first conductive layers 311*a* and 312*a* may be unevenly formed, or characteristics of the coil component may be deteriorated.

The external electrodes 400 and 500 may be disposed on surfaces of the body 100, and may be connected to both end portions of the coil portion 300, respectively. In this embodiment, both end portions of the coil portion 300 may be exposed from the first and second surfaces 101 and 102 of the body 100, respectively. The first external electrode 400 may be disposed on the first surface 101 and may be in contact with and connect to an end portion of the first coil pattern 311 exposed from the first surface 101 of the body 100, and the second external electrode 500 may be disposed on the second surface 102 and may be in contact with and connect to an end portion of the second coil pattern 312 exposed from the second surface 102 of the body 100.

The external electrodes 400 and 500 may have a single-layer structure or a multilayer structure. For example, the first external electrode 400 may include a first layer comprising copper, a second layer disposed on the first layer and comprising nickel (Ni), and a third layer disposed on the second layer and comprising tin (Sn). The first to third layers may be formed by an electrolytic plating process, but is not limited thereto. As another example, the first external electrode 400 may include a resin electrode including a conductive powder particle and a resin, and a plating layer formed by a plating process on the resin electrode.

The external electrodes 400 and 500 may be formed of a conductive material such as copper (Cu), aluminum (Al), silver (Ag), tin (Sn), gold (Au), nickel (Ni), lead (Pb), titanium (Ti), or alloys thereof, but is not limited thereto.

The insulating film 600 may be formed on the insulating substrate 200 and the coil portion 300. The insulating film 600 may be for insulating the coil portion 300 from the body 100, and may include a known insulating material such as parylene, and the like. An insulating material included in the insulating film 600 may be any material, and is not particularly limited thereto. The insulating film 600 may be formed using a vapor deposition process or the like, but not limited thereto, and may be formed using stacking an insulation film on both surfaces of the insulating substrate 200. In the former case, the insulating film 600 may be formed in the form of a conformal film along the surfaces of the insulating substrate 200 and the coil portion 300. In the latter case, the insulating film 600 may be formed to fill a space between neighboring turns of the coil patterns 311 and 312. As described above, a plating resist may be formed on the insulating substrate 200 for forming the second conductive layers 311*b* and 312*b*, and such a plating resist may be a permanent resist which may be not removed. In this case, the insulating film 600 may be a plating resist which may be a permanent resist. The insulating film 600 may be omitted, when the body 100 secures sufficient insulation resistance under operating conditions of the coil component 1000 according to this embodiment.

Figure 7:
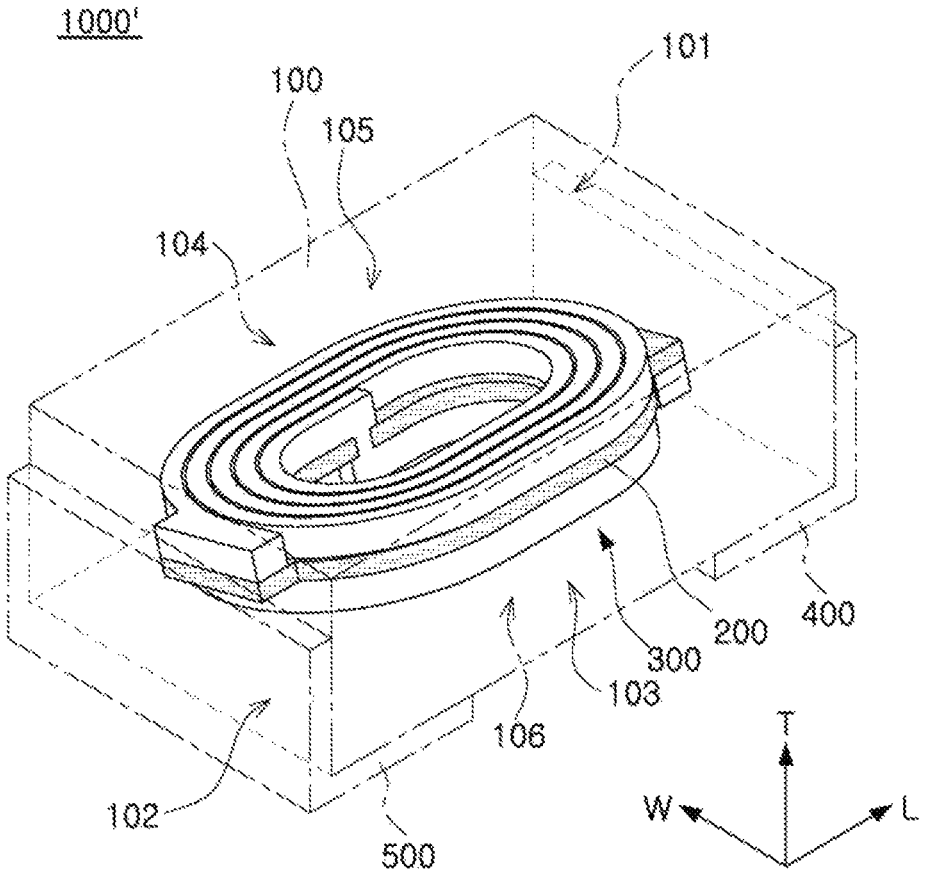
FIG. 7 is a schematic view illustrating a coil component according to a modified embodiment of the present disclosure.

FIG. 7 is a schematic view illustrating a coil component according to a modified embodiment of the present disclosure.

Referring to FIG. 7, each of the first and second external electrodes 400 and 500 applied to this modified embodiment may be arranged on the first and second surfaces 101 and 102 of the body 100, but may only be formed on a portion of each of the first and second surfaces 101 and 102 of the body 100 in the thickness direction T of the body 100. For example, the first and second external electrodes 400 and 500 may not be formed to cover the entirety of the first and second surfaces 101 and 102 of the body 100, respectively. Each of the first and second external electrodes 400 and 500 may extend onto only one of the fifth and sixth surfaces 105 and 106, for example, the sixth surface 106.

In the case of the present disclosure, the insulating substrate 200 may not be inclined in the body 100 at a cross-section (L-T plane) in the length-thickness direction of the body 100. For example, as illustrated in FIGS. 2 and 3, each of the end portions of the first and second coil patterns 311 and 312, exposed from the first and second surfaces 101 and 102 of the body 100, may be only rotated about an axis parallel to the longitudinal direction L of the body 100 in a relatively constant position on the first and second surfaces 101 and 102 of the body 100. Therefore, a difference in height between the end portion of the first coil pattern 311 on the first surface 101 of the body 100 and the end portion of the second coil pattern 312 on the second surface 102 of the body 100 may be smaller than a case in which the insulating substrate and the coil portion are arranged in the body by rotating about an axis parallel to the width direction W of the body.

As a result, although each of the first and second external electrodes 400 and 500 are formed not to cover the entirety of the thickness direction T of the body 100 of the first and second surfaces 101 and 102 of the body 100, the connection reliability between the first and second external electrodes 400 and 500 and the coil portion 300 may be secured.

Therefore, the coil components 1000 and 1000' according to this embodiment and the modified embodiment may improve the maximum cross-sectional area of the core 110, and improve component characteristics such as inductance and quality coefficient. In addition, the coil components 1000 and 1000' according to this embodiment and the modified embodiment may secure the connection reliability with the coil portion 300, even when the height of the external electrodes 400 and 500 are formed to be relatively small.

According to the present disclosure, it is possible to realize a high-capacity inductance while reducing the coil component to a low-profile.

While example embodiments have been shown and described above, it will be apparent to those skilled in the art that modifications and variations could be made without departing from the scope of the present disclosure as defined by the appended claims.

What is claimed is:

1. A coil component comprising:

a body having a first surface and a second surface opposing each other in a first direction, and having a third surface and a fourth surface opposing each other in a second direction, perpendicular to the first direction;

an insulating substrate embedded in the body;

a coil portion disposed on at least one surface of the insulating substrate, and having end portions extending from the third surface and the fourth surface of the body, respectively; and a first external electrode and a second external electrode disposed on the third surface and the fourth surface of the body and connected to the end portions of the coil portion, respectively, wherein on a cross-section perpendicular to the second direction, the at least one surface of the insulating substrate, on which the coil portion is disposed, is inclined with respect to the first surface of the body.

2. The coil component according to claim 1, wherein the insulating substrate has a through-hole therein, wherein a longitudinal axis of the through-hole and the first direction has an angle of 10 degrees or more and 20 degrees or less on the cross-section of the body, perpendicular to the second direction.

3. The coil component according to claim 1, wherein a thickness (T1) of the insulating substrate is 20 μm or more and 40 μm or less.

4. The coil component according to claim 1, wherein the coil portion comprises a first conductive layer having a lower surface in contact with the insulating substrate, and a second conductive layer disposed on the first conductive layer.

5. The coil component according to claim 4, wherein a thickness (T2) of the first conductive layer is 1.5 μm or more and 3 μm or less.

6. The coil component according to claim 4, wherein a thickness (T1) of the insulating substrate and a thickness (T2) of the first conductive layer satisfy $10 \leq T1/T2 \leq 20$.

7. The coil component according to claim 4, wherein the second conductive layer exposes at least a portion of a side surface of the first conductive layer.

8. The coil component according to claim 4, wherein the second conductive layer covers side surfaces of the first conductive layer and an upper surface of the first conducive layer opposing the lower surface of the first conductive layer.

9. The coil component according to claim 4, wherein the coil portion comprises:

a first coil pattern, having a planar spiral shape, disposed on the one surface of the insulating substrate;

a second coil pattern, having a planar spiral shape, disposed on another surface of the insulating substrate, opposing the one surface of the insulating substrate; and a via passing through the insulating substrate to connect the first coil pattern and the second coil pattern, wherein each of the first and second coil patterns comprises the first and second conductive layers.

10. The coil component according to claim 1, wherein the first external electrode is disposed on only a portion of the third surface of the body, and the second external electrode is disposed on only a portion of the fourth surface of the body.

11. The coil component according to claim 1, wherein the at least one surface of the insulating substrate is substantially perpendicular to one of the third and fourth surfaces of the body.

12. The coil component according to claim 1, wherein on the cross-section perpendicular to the second direction, an angle between the at least one surface of the insulating substrate and the first surface of the body is 10 degrees or more and 20 degrees or less.

13. The coil component according to claim 1, wherein the at least one surface of the insulating substrate is substantially perpendicular to the first and second external electrodes.

14. The coil component according to claim 1, wherein upper and lower surfaces of the coil portion are substantially perpendicular to the first and second external electrodes.

15. The coil component according to claim 1, wherein the at least one surface of the insulating substrate, on which the coil portion is disposed, is non-perpendicular to a side surface of the body connected to the first to fourth surfaces of the body.

* * * * *